US009250037B2

(12) United States Patent
Seugnet et al.

(10) Patent No.: US 9,250,037 B2
(45) Date of Patent: Feb. 2, 2016

(54) METHOD FOR DETERMINING CORRECTIONS FOR ARTILLERY FIRE

(71) Applicant: THALES, Neuilly-sur-Seine (FR)

(72) Inventors: Patrick Seugnet, Chatillon (FR); Stéphane Godio, Suresnes (FR)

(73) Assignee: THALES, Courbevoie (FR)

( * ) Notice: Subject to any disclaimer, the term of this patent is extended or adjusted under 35 U.S.C. 154(b) by 0 days.

(21) Appl. No.: 14/395,585

(22) PCT Filed: Apr. 15, 2013

(86) PCT No.: PCT/EP2013/057786
§ 371 (c)(1),
(2) Date: Oct. 20, 2014

(87) PCT Pub. No.: WO2013/156434
PCT Pub. Date: Oct. 24, 2013

(65) Prior Publication Data

US 2015/0075359 A1 Mar. 19, 2015

(30) Foreign Application Priority Data

Apr. 20, 2012 (FR) ..... 12 01168

(51) Int. Cl.

| | |
|---|---|
| ***G06G 7/80*** | (2006.01) |
| ***F41G 3/06*** | (2006.01) |
| ***F41G 3/02*** | (2006.01) |
| ***F41G 3/14*** | (2006.01) |

(52) U.S. Cl.
CPC *F41G 3/065* (2013.01); *F41G 3/02* (2013.01); *F41G 3/06* (2013.01); *F41G 3/142* (2013.01)

(58) Field of Classification Search
USPC ..... 235/404, 454
See application file for complete search history.

(56) References Cited

U.S. PATENT DOCUMENTS

| | | | | |
|---|---|---|---|---|
| 8,408,460 | B2 * | 4/2013 | Schneider et al. | 235/412 |
| 2009/0123894 | A1 | 5/2009 | Svane et al. | |
| 2010/0182426 | A1 | 7/2010 | Perruchot et al. | |
| 2011/0315767 | A1 | 12/2011 | Lowrance | |

FOREIGN PATENT DOCUMENTS

| | | | |
|---|---|---|---|
| FR | 2921149 | A1 | 3/2009 |

* cited by examiner

*Primary Examiner* — Jamara Franklin
(74) *Attorney, Agent, or Firm* — Baker & Hostetler LLP

(57) ABSTRACT

A method determining artillery fire corrections toward a fixed target using a fixed observation system is oriented and equipped with a device measuring orientation of line of sight, a laser rangefinder, a positioning device, and a display screen with fixed crosshair, displaying and moving another crosshair. The method includes: orienting the observation system to display the central crosshair on the target image and calculating target geographical coordinates using distance provided by the rangefinder. If, after firing, the impact and target do not coincide, the method includes, if the orientation is fixed: displaying a second crosshair on the impact image and measuring offset between the two crosshairs, displaying a third crosshair symmetrical to the second crosshair; and orienting the optronic system to position the third crosshair on the target image, the first crosshair coinciding with the impact point image, and actuating the rangefinder to obtain distance between the system and impact.

5 Claims, 3 Drawing Sheets

METHOD FOR DETERMINING CORRECTIONS FOR ARTILLERY FIRE

CROSS-REFERENCE TO RELATED APPLICATIONS

This application is a National Stage of International patent application PCT/EP2013/057786, filed on Apr. 15, 2013, which claims priority to foreign French patent application No. FR 1201168, filed on Apr. 20, 2012, the disclosures of which are incorporated by reference in their entirety.

FIELD OF THE INVENTION

The field of the invention is that of artillery fire.

BACKGROUND

During artillery fire, a forward observer is placed between the artillery pieces and a fixed target, typically at approximately 1 or 2 km from the target, the artillery pieces being placed to the rear at a distance typically between 5 and 50 km for terrestrial artillery fire. This observer, who has a direct view of the target, is initially responsible for determining the position of this target. This is referred to as extraction of coordinates of the target.

The latter are obtained in the following manner by means of a fixed but orientable optronic observation system such as a multifunctional scope or binoculars fixed to a tripod.

This observation system described with reference to FIG. 4 conventionally includes an observation channel that includes an image sensor 2 and a laser rangefinder channel referred to as the laser channel that includes a rangefinder 4; it also includes a display screen 1 common to the two channels on which appears the image 10 from the image sensor and on which is positioned a rangefinding crosshair R1 showing the aiming axis of the laser rangefinder, as can be seen in FIG. 1. This crosshair generally takes the form of a cross. The laser beam of the rangefinder is emitted in a very narrow sector typically of approximately 1 mrad, which imposes very accurate pointing of the laser. A harmonization, that is to say alignment of the axes of the laser channel and the observation channel, is factory-set; as a result of this the crosshair R1 is located substantially at the center of the screen 1. To measure the range of the target, the operator orients the binoculars so as to position the laser crosshair R1 over the image of the target after which rangefinding is effected by means of a user interface 7, for example by action on a pushbutton. The observation system is furthermore equipped with means 5 for measuring the orientation of the aiming axis (of the observation channel or of the rangefinding channel since they have the same axis), such as a magnetic compass, a goniometer or a gyrocompass, etc., or any other means, and positioning means 6 such as a two-antenna GPS system, for example.

This observation system is for example mounted on a tripod and therefore has a fixed geographical position and can be oriented. As indicated, the observer orients the observation system so as to make the crosshair R1 coincide on the display screen 1 with the image 10 of the target as shown in FIG. 1. They then operate the rangefinder to measure the distance D between the system and the target, at the same time as the measured position and orientation of the system are respectively calculated by the positioning and orientation means. The coordinates of the target are extracted from these three measurements and transmitted to the artillery pieces, for example by voice transmission.

A certain number of factors may lead to the first impact not being on the target:

Inaccuracy of the extraction of coordinates,
Defective adjustment of the artillery piece,
Temperature of the powder and the barrel,
Wind,
Etc.

If the first impact is not on the target, the second mission of the forward observer is to provide the operators of the artillery pieces with the parameters necessary for the determination of artillery fire corrections to be made to achieve a second strike, this time on the target. The forward observer provides three parameters, as indicated in FIG. 2:

target observation bearing,
distance to right or left between impact and target, which is 10 m more to the left in the example in the figure,
distance of the impact in front of or behind the target, which is 15 m closer in the example in the figure.

These parameters are calculated on the basis of the measurement of the following elements, knowing that the measurement of the distance D resulting from the coordinate extraction step is considered sufficiently accurate:

Distance D' between the observer and the impact,
Orientation offset between the impact and the target: in practice this is an offset in bearing.

To prevent the image of this second strike being outside the target and therefore to minimize collateral damage, the calculation of these parameters must be as accurate as possible, notably with an angular accuracy of one mrad, the accuracy in respect of D' being sufficient.

In fact, the distance D' is obtained by laser rangefinding with sufficient accuracy of the order of ±5 m.

At present there are two devices for determining the offset in bearing between the target and the impact:

The magnetic compass,
The goniometer.

The magnetic compass is a device sensitive to the terrestrial magnetic field and enables magnetic North to be determined at a location; it is then easy to deduce geographical North at this location, by adding the magnetic declination. With the aid of a magnetic compass it is possible to measure by pointing at a target the observation bearing to that target. By pointing toward the impact and effecting a subtraction, it is possible to determine the offset in bearing between the target and the impact. The advantage of the device lies in its compactness and its lightness. It is easy to integrate into more complex systems such as multifunction binoculars, for example. Its disadvantage is linked to the sensitivity of this type of sensor, which is extremely sensitive to interference and in the best possible scenario is unable to guarantee a measurement to within less than 10 mrad. Now this accuracy of 10 mrad is highly insufficient since the order of magnitude of the artillery fire corrections that it is required to provide is 1 milliradian.

The goniometer is a relative angle measuring device. It makes it possible to measure a relative angle with great accuracy, less than one mrad. By successively pointing the sight line of binoculars at the target and then at the impact point, it enables the offset in bearing to be measured with the required accuracy. The disadvantage of the goniometer is that it is heavy and bulky, which is a penalty for tactical hardware, and that it adds a non-negligible cost to the system.

It is also possible to calculate these correction parameters using an observation system such as binoculars or a scope, the display screen of which is provided with a micrometric crosshair R1, i.e. one completed by small markers, the distance between two markers defining a field of view, as represented in FIG. 1. Observers evaluate the offset in bearing and in elevation for themselves as a function of the offset that they observe on their display screen 1 between the micrometric crosshair R1 positioned over the image 10 of the target and the image 11 of the impact on their screen; however, this evaluation by the observers themselves cannot achieve the required accuracy of the order of 1 mrd. By rangefinding, they then measure the distance after first orienting their observation system toward the impact, that is to say positioning the crosshair over the image of the impact.

Consequently, there remains at present a requirement for a system simultaneously satisfying all the aforementioned requirements, in terms of the accuracy of the corrections to be made, compactness, lightness and cost.

SUMMARY OF THE INVENTION

To be more precise, the invention consists in a method for determining corrections for artillery fire toward a fixed target using a fixed optronic geographical positioning system which can be oriented and equipped with a device for measuring the orientation of the line of sight thereof, a laser rangefinder, system positioning means, a display screen provided with a fixed crosshair and harmonized with the axis of the rangefinder, and means for displaying and moving another crosshair on the screen, which method includes the following step:

- orienting the observation system so as to display the fixed crosshair on the image of the target on the display screen and calculating geographical coordinates of the target as a function of the distance provided by the rangefinder, the orientation provided by the orientation-measuring device, and the position of the optronic system provided by the positioning means.

It is primarily characterized in that, in the event that, after firing, the impact of this firing and the target do not coincide, it includes the following steps:

- the orientation of the system being fixed:
  - displaying on the display screen a second crosshair on the image of the impact and measuring on the display screen the offset between the two crosshairs,
  - displaying a third crosshair on the display screen at a position that is symmetrical to that of the second crosshair relative to the first crosshair,
- orienting the optronic system in order to position the third crosshair on the image of the target, the first crosshair then coinciding with the image of the impact point, and
- actuating the rangefinder in order to obtain the distance between the system and the impact.

This notably makes it possible to measure the distance between the observation system and the impact point even if the latter as seen by the observer and/or its image on the screen has moved or disappeared.

The second and third crosshair are optionally displayed simultaneously.

The rangefinding step may be repeated, for example if no echo is obtained by the rangefinder.

In accordance with one feature of the invention, the field of view of the display screen being liable to vary, it includes after the coordinate extraction step a step of enlarging the field of view of the display screen.

The invention also consists in an optronic observation system that can be oriented and is equipped with a device for measuring the orientation of its line of sight, a laser rangefinder, means for determining the position of the system, a display screen provided with a fixed crosshair and harmonized with the axis of the rangefinder, a user interface and a processor unit, characterized in that it includes means for displaying and moving two other crosshairs on the screen, and in that the processor unit includes means for implementing the method as described.

BRIEF DESCRIPTION OF THE DRAWINGS

Other features and advantages of the invention will become apparent on reading the following detailed description given by way of nonlimiting example and with reference to the appended drawings, in which.

From one figure to another, the same elements are identified by the same references.

DETAILED DESCRIPTION

It is considered that a first firing often referred to as a test firing takes place after the transmission of the coordinates of the target to the artillery pieces. The observer awaits the impact of this test firing, keeping the crosshair R1 over the image of the target, without modifying the orientation of the observation system. R1 is generally at the center of the display screen 1.

Figure 1:
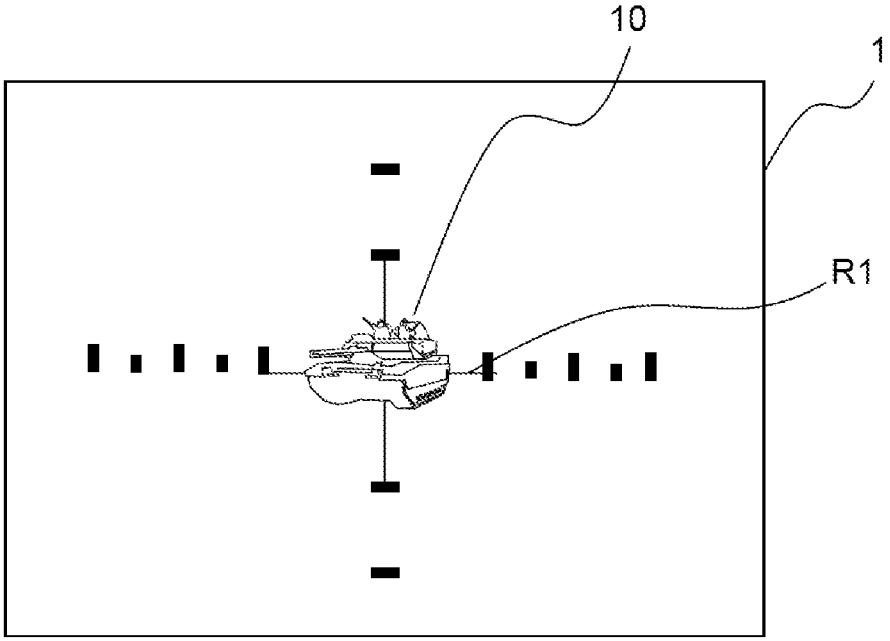
FIG. 1, already described, represents diagrammatically an example of a target image on a display screen, FIG. 2, already described, illustrates the artillery fire corrections to be made, FIG. 3 illustrate the various steps of displaying the crosshairs R2 and R3 in accordance with the invention.
Figure 2:
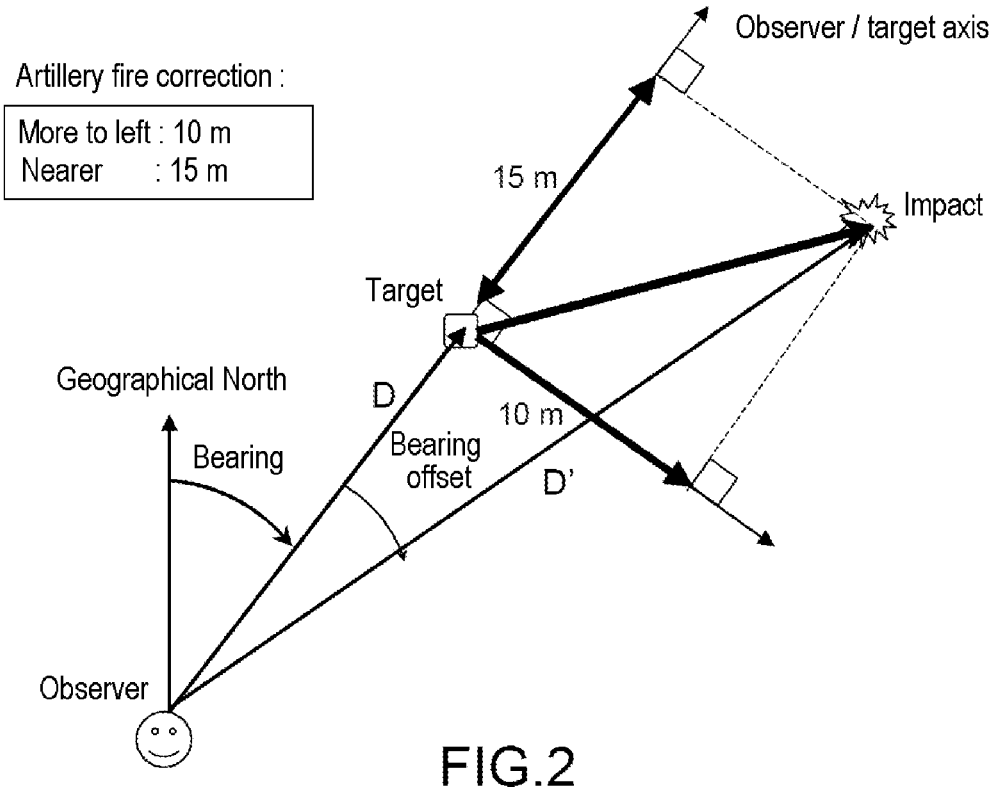
Figure 3A:
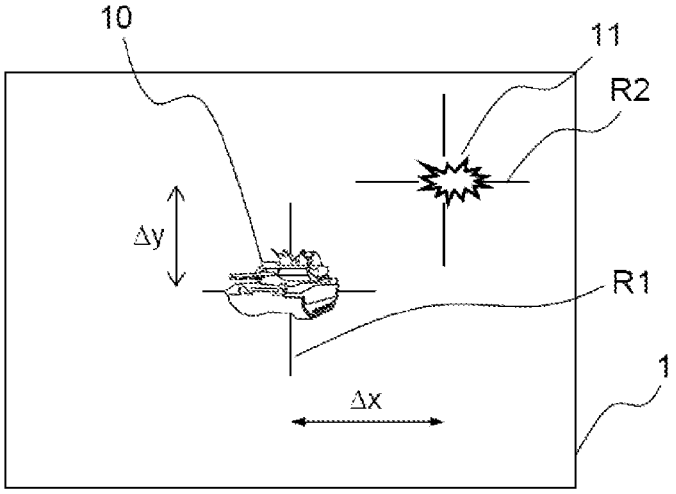

On impact, using means for displaying and moving a second crosshair R2 on the screen, the operator places this crosshair R2 over the image 11 of the impact point on the screen without modifying the orientation of the binoculars, as shown in FIG. 3*a*. These means for moving a crosshair comprise for example a joystick or pushbuttons or a device scanning the retina of the observer. Positioning the crosshair R2 over the image 11 of the impact point makes it possible to measure $\Delta x$ (=horizontal offset of R2 relative to R1), which makes it possible to determine the offset in bearing with the very high angular accuracy of the display screen. This is typically a microdisplay type screen with an eyepiece or an offset flat screen. The microdisplay is of the OLED or liquid crystal (LCD) type, with a predetermined bearing angle associated with each pixel; this is typically approximately 0.1 mrd to within 5%. The required accuracy of the order of 1 mrd is therefore more than adequately achieved by measuring $\Delta x$ as a number of pixels. The same applies for the offset in elevation obtained by measuring $\Delta y$, but the main contribution is that of the offset in bearing.

The horizontal field of a screen is typically approximately 3°, that is to say approximately 50 mrd, which corresponds to a field of view covering approximately 150 m for an observer at a distance of 3 km.

If the impact point may be outside this field of view, the observer may optionally enlarge this field of view before the test firing, the bearing angle associated with each pixel being increased accordingly, of course.

It then remains to measure the distance D' between the observation system and the impact point by means of the rangefinder knowing that the axis of the latter is harmonized with the axis represented by the crosshair R1. Now, at this stage, R1 is over the image 10 of the target.

It is therefore necessary to modify the orientation of the observation system so as to position the crosshair R1 over the image of the impact point. However, the impact point seen by the observer and its image on the screen may have moved, or even disappeared; smoke at the impact point may have dissipated, for example.

Figure 3B:
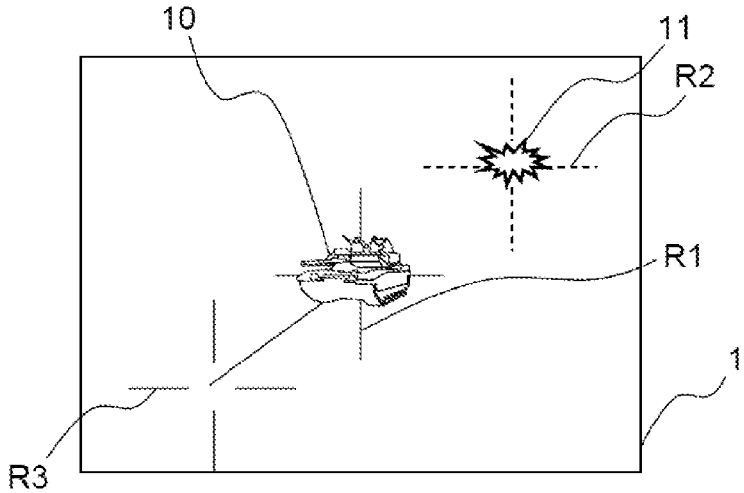

A third crosshair R3 is displayed on the screen symmetrically to the crosshair R2 relative to R1 (to be more precise relative to the center of R1); this is shown in FIG. 3*b*. This display may be simultaneous with that of R2 or follow it. It may be effected by the observer but it is preferably done automatically by the processor unit 3 of the observation system, which counts the pixels between R1 and R2, that is to say $\Delta x$ and $\Delta y$ (=vertical offset of R2 relative to R1 corresponding to an offset in elevation).

Figure 3C:
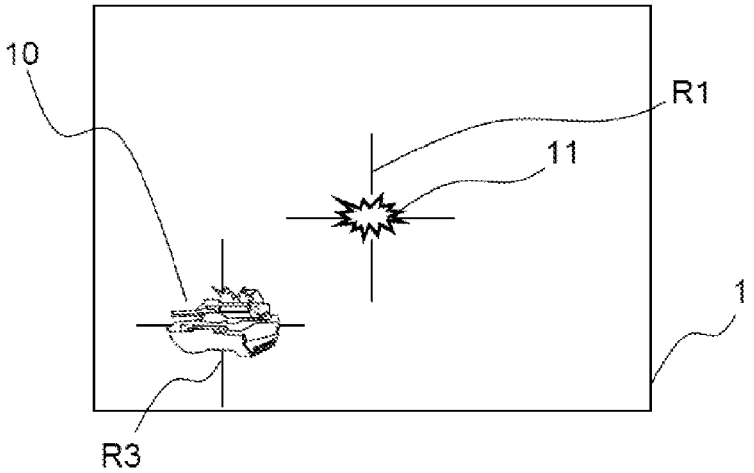
Figure 4:
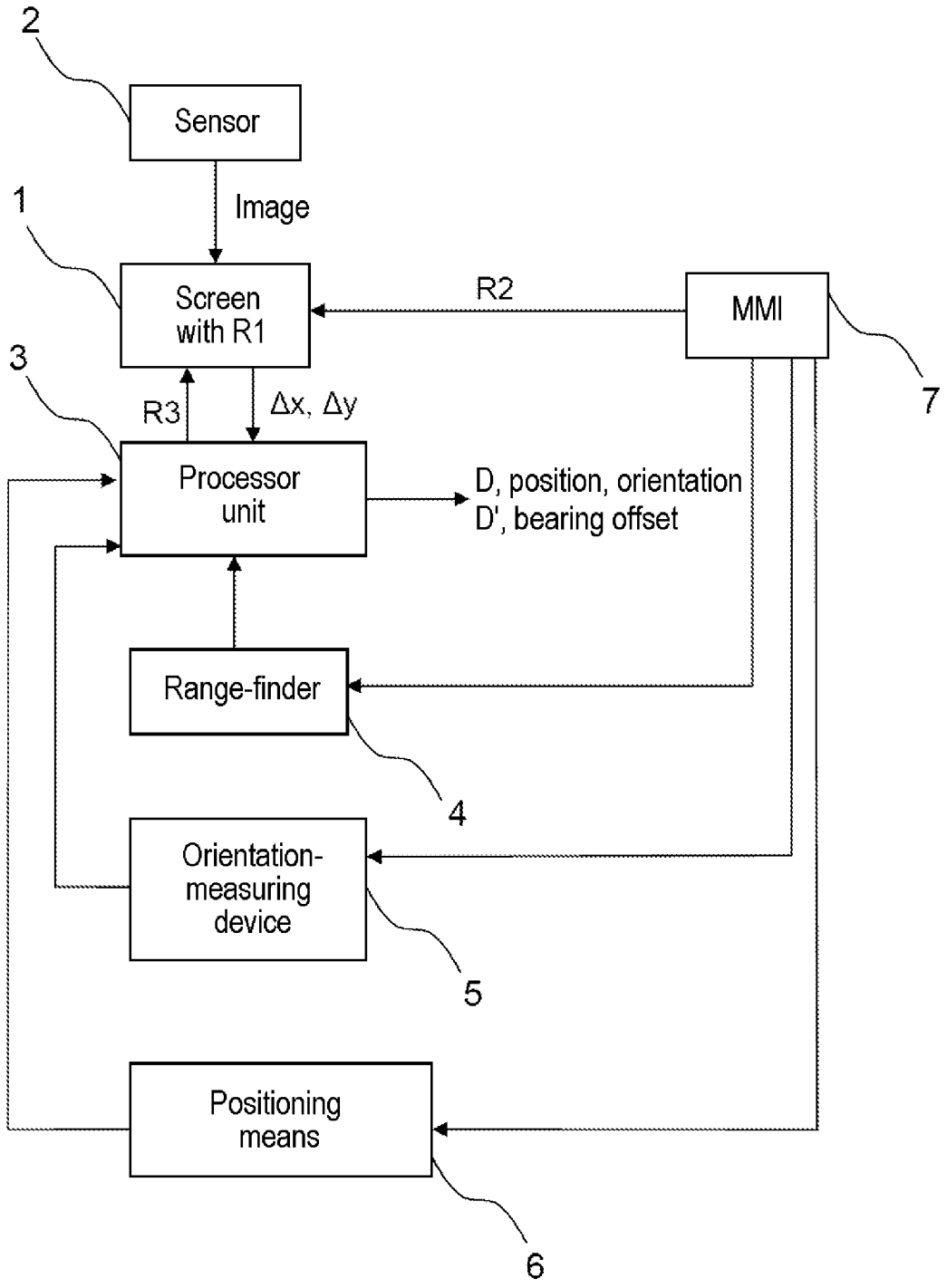
FIG. 4 represents diagrammatically one example of an observation system.

As shown in FIG. 3*c*, the observer then modifies the orientation of the observation system so as to position the crosshair R3 over the image of the target 10, which by construction brings the crosshair R1 and therefore the line of sight of the rangefinder over the image of the impact point 11. By doing this, the impact point becomes the physical reference common to the observer and to the artillery pieces instead of geographical North. They then operate the rangefinder to be able to measure the distance D' between the observation system and the impact point. This rangefinding step is optionally repeated as long as no echo from the impact point is detected by the rangefinder.

Also knowing its position, the observation system then has all the data (position, offset in orientation, distances D and D') for determining the offset between the target and the impact point of the artillery fire, with the accuracy of a goniometer-based system but without employing the latter.

The invention claimed is:

1. A method for determining corrections for artillery fire toward a fixed target using a fixed optronic geographical positioning system which can be oriented and equipped with a device for measuring the orientation of the line of sight thereof, a laser rangefinder, system positioning means, a display screen provided with a fixed crosshair and harmonized with the axis of the rangefinder, and means for displaying and moving another crosshair on the screen, which method includes the following step:

orienting the observation system so as to display the fixed crosshair on the image of the target on the display screen and calculating geographical coordinates of the target as a function of the distance provided by the rangefinder, the orientation provided by the orientation-measuring device, and the position of the optronic system provided by the positioning means, wherein, in the event that, after firing, the impact of the firing and the target do not coincide, it includes the following steps:

the orientation of the system being fixed:

displaying on the display screen a second crosshair on the image of the impact and measuring on the display screen the offset between the two crosshairs, displaying a third crosshair on the display screen at a position that is symmetrical to that of the second crosshair relative to the first crosshair, orienting the optronic system in order to position the third crosshair on the image of the target, the first crosshair then coinciding with the image of the impact point, and actuating the rangefinder in order to obtain the distance between the system and the impact.

2. The method as claimed in claim 1 of determining corrections for artillery fire, wherein the second crosshair and the third crosshair are displayed simultaneously.

3. The method as claimed in claim 1 of determining corrections for artillery fire, wherein the rangefinding step is repeated.

4. The method as claimed in claim 1 of determining corrections for artillery fire, wherein the field of view of the display screen being liable to vary, it includes after the coordinate extraction step a step of enlarging the field of view of the display screen.

5. An optronic observation system that can be oriented and is equipped with a device for measuring orientation of its line of sight, a laser rangefinder, means for determining the position of the system, a display screen provided with a fixed crosshair and harmonized with the axis of the rangefinder, a user interface and a processor unit, further comprising means for displaying and moving two other crosshairs on the screen, and wherein the processor unit includes means for implementing a method for determining corrections for artillery fire toward a fixed target using the optronic observation system, which method includes the following steps:

orienting the observation system so as to display the fixed crosshair on the image of the target on the display screen and calculating geographical coordinates of the target as a function of the distance provided by the rangefinder, the orientation provided by the orientation-measuring device, and the position of the optronic system provided by the positioning means, wherein, in the event that, after firing, the impact of the firing and the target do not coincide, the method includes the following steps:

the orientation of the system being fixed:

displaying on the display screen a second crosshair on the image of the impact and measuring on the display screen the offset between the two crosshairs, displaying a third crosshair on the display screen at a position that is symmetrical to that of the second crosshair relative to the first crosshair, orienting the optronic system in order to position the third crosshair on the image of the target, the first crosshair then coinciding with the image of the impact point, and actuating the rangefinder in order to obtain the distance between the system and the impact.

* * * * *